US005314160A

United States Patent [19]

Larsen

[11] Patent Number: 5,314,160

[45] Date of Patent: May 24, 1994

[54] WALL HANGER ASSEMBLY

[75] Inventor: William H. Larsen, Caguas, P.R.

[73] Assignee: Larsen Products, Inc., Caguas, P.R.

[21] Appl. No.: 11,787

[22] Filed: Feb. 1, 1993

[51] Int. Cl.[5] ..... F16M 13/00

[52] U.S. Cl. ..... 248/547; 248/489; 411/441; 411/469; 411/480

[58] Field of Search ..... 248/547, 544, 546, 489, 248/475.1, 497, 466, 909; 81/44, 23; 411/441, 480, 482, 469

[56] References Cited

U.S. PATENT DOCUMENTS 4,040,149 8/1977 Einhorn ..... 248/497 X
4,124,189 11/1978 Einhorn ..... 248/489
4,582,288 4/1986 Ruehl ..... 411/482 X
4,691,598 9/1987 Lin ..... 81/44
4,896,852 1/1990 Akema ..... 248/909 X

*Primary Examiner*—Ramon O. Ramirez
*Attorney, Agent, or Firm*—Oblon, Spivak, McClelland, Maier & Neustadt

[57] ABSTRACT

A hanger assembly particularly useful for hanging objects on a masonry wall includes a body for receiving case hardened nails and having attached thereto by a frangible connection one end of a handle which can be broken away from the body after the nail has been driven into the wall. A second hanger body can be connected to the opposite end of the handle.

17 Claims, 2 Drawing Sheets

WALL HANGER ASSEMBLY

FIELD OF THE INVENTION

This invention relates to wall hangers and more particularly to wall hanger assemblies particularly though not exclusively adopted for hanging objects on masonry walls.

BACKGROUND OF THE INVENTION

The present inventor has previously created, manufactured and sold a highly successful wall hanger particularly designed for use for hanging objects on masonry walls. The hanger comprises a cylindrical body of molded plastic having flanges at either end and a central bore extending from an open end at the front face of the body into the body where the bore terminates short of its rear face. The bore is designed to frictionally receive and guide a case-hardened, headed nail as it is hammered into the masonry which may be brick, concrete, cement, stone or any similar substance. For proper guidance of the nail, the body must be held with its rear face against the wall as the nail is driven into the wall. It is dangerous to hold the body in place with the fingers while the nail is driven since several quite strong hammer blows are required and almost invariably the hammer does not hit true and slips to one side which can seriously injure the user's fingers. In that prior system, which is still enjoying marked commercial success, I devised a separate handle made of plastic having at one end open jaws, which snapped around the hanger body between the flanges. Thus the user grasped the handle at a position remote from the hanger body and was safe from being struck as the nail was driven into the wall. This system works extremely well but a significant problem manifested itself in that the handle was easily lost and without it, it was so dangerous to hammer a nail into a masonry wall that remaining hangers were unused. One could hold a hanger in place with needle nosed pliers but should the hammer slip and strike the pliers, the user's fingers were injured almost as badly as if struck directly by the hammer.

Thus an object of the invention is to provide a masonry wall hanger which has an integral handle molded to the hanger body but with a frangible connection which permits the ready separation of the handle from the hanger body after the nail has been driven fully into the wall.

It is another object of the invention to provide a hanger body at each end of the handle whereby a single handle serves two hangers.

Still another object of the invention is to provide two different types of hangers at the opposite ends of the handle, one, for example, being designed for hanging heavy objects, such as a relatively large picture or a mirror, on the wall and the other for hanging small objects.

A further object is to provide a cap for a multi-nail hanger to cover the nail heads.

Other objects and their attendant advantages will become apparent as the following detailed description is read in conjunction with the accompanying drawings.

DETAILED DESCRIPTION OF THE INVENTION

Figure 3:
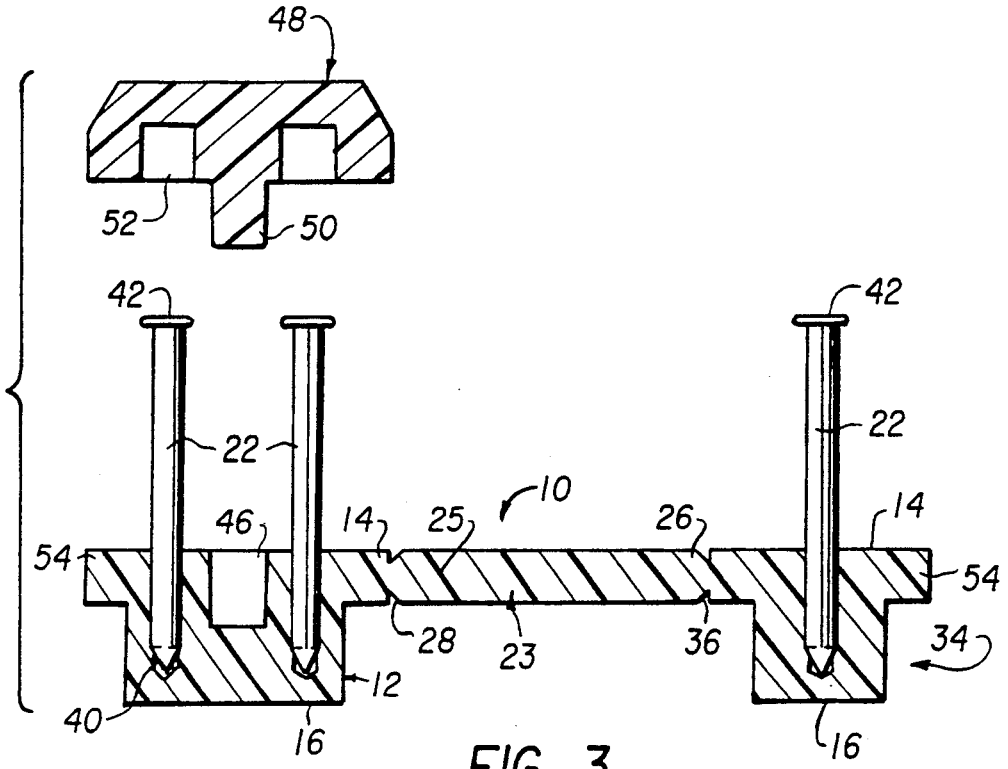
FIG. 3 is view similar to FIG. 2 but showing nails positioned for hammering, and also showing in cross section a cap for use with one of the hanger bodies.
Figure 1:
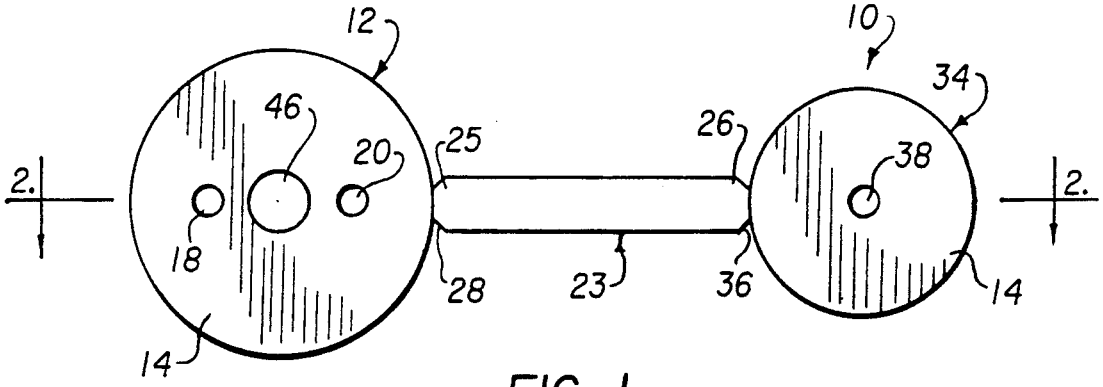
FIG. 1 is a horizontal plan view of the hanger assembly of the invention.
Figure 2:
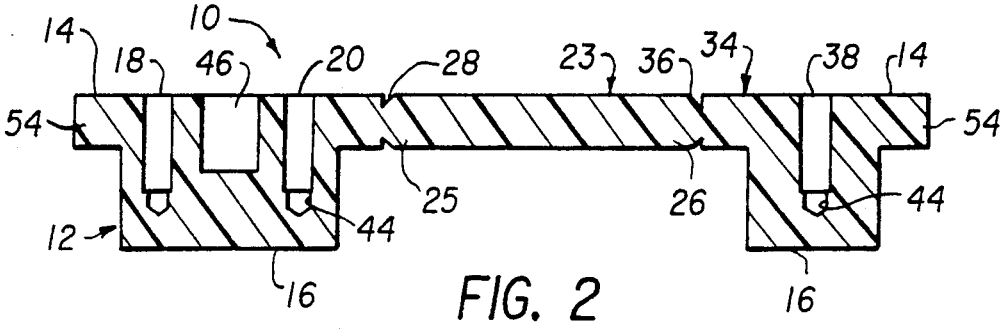
FIG. 2 is a vertical cross sectional view taken substantially on the line 2—2 of FIG. 1.

With reference to FIGS. 1 and 2 the hanger assembly 10 of the invention comprises a first hanger body 12, preferably of molded plastic, having spaced apart front and rear faces 14, 16. At least one bore, and in the case of the first hanger body 12, two bores 18, 20, extend from an open outer end at the front face 14 into the hanger body. The bores have cross sectional dimensions complementary to fastening elements, which may be case hardened nails 22 as shown in FIG. 3, inserted into the bores 18, 20 through their open ends preparatory, to being hammered into a wall 24 (FIG. 6) which may be masonry. It will be apparent that the hanger can be used on any type of wall though it is particularly adapted for use on masonry walls which may be cement, concrete, brick, stone, or any similar substance.

Figure 6:
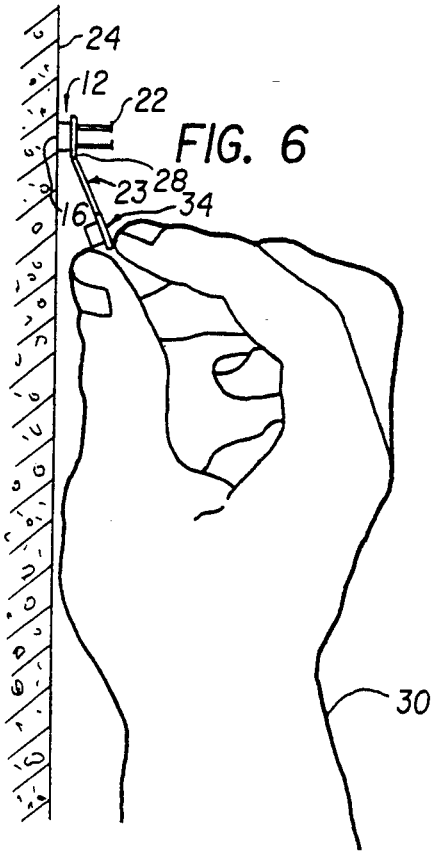
FIG. 6 shows the manner of use of the invention preparatory to hammering nails into a surface.

In accordance with the invention a handle 23 has first and second opposed ends 25, 26, one of which, end 25, is joined to the body 12 by an integral frangible connection 28. With reference to FIG. 6, it can be seen that the handle 22 has a length to permit grasping by the hand 30 of a user to hold the body 12 with its rear face against the wall 24 to enable a fastening element 22 inserted into a bore 18 or 20 to be driven into the wall clear of the grasping hand 30 of the user. In accordance with the invention, the frangible connection 28 is flexible to enable the handle to be angularly flexed away from the wall 24 as shown in FIG. 6, and is also constructed to permit ready separation of the handle 23 from the body 12 upon completion of the driving of the nail or nails into the wall 24.

In accordance with the invention a second hanger body 34, which may be identical to, or at least substantially similar to body 12, is joined to the other end 26 of the handle 23 by a second integral frangible connection 36. The parts of the second body 34 which are identical to the first body are designated by the same reference characters. The first body 12 has the two bores 18, 20 (it could have more bores) in order that it can be secured to the walls by at least two nails in order to support a relatively heavy object such as a mirror. The body 34 may have a single bore 38 whereby a relatively light object can be supported on a wall.

Figure 4:
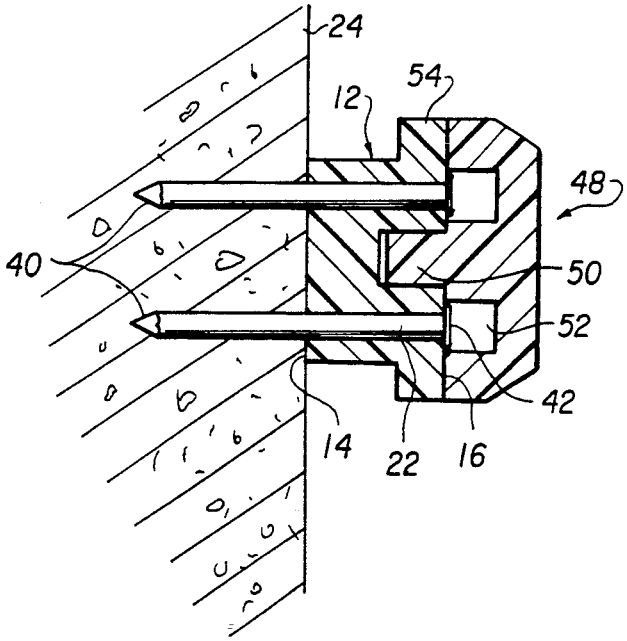
FIG. 4 is a vertical cross sectional assembled view of a double-nail hanger showing the nails hammered into the wall.
Figure 5:
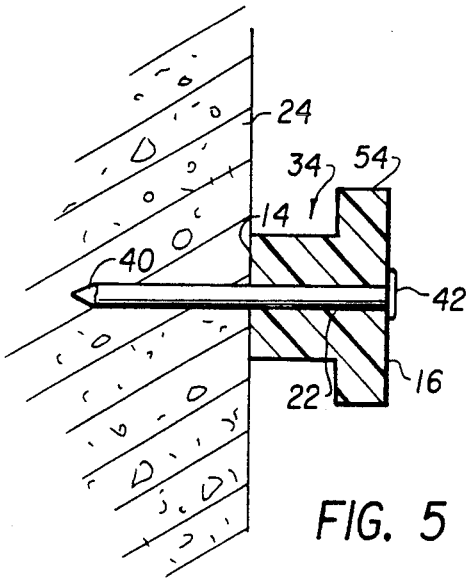
FIG. 5 is a view similar to FIG. 4 for a single nail hanger.

As can be seen in FIGS. 2 and 3 the bores 18, 20 and 38 terminate short of the rear faces 16 of the bodies 12, 34, the material of the assembly being penetrable by the fastener elements 22 which are, of course, pointed at their ends 40 opposite their heads 42. In accordance with the invention the inner ends of the bores 18, 20, 38 are counter bored at 44 (FIG. 1) to a lesser diameter than the bores to provide frictional guides for the sharpened inner ends 40 of the fastener elements when initially inserted into the bores. Thus, if the nails do not have sufficient frictional engagement with the main bores to prevent them from sliding out should the body be tilted preparatory to the nailing operation, when the nail is first inserted the user pushes with some slight force on the nail to cause its point 40 to be wedged into the counter bore 44 as seen in FIG. 3 to ensure that the nail is held firmly in place as the hanger assembly is maneuvered into position for hammering.

Where a hanger body is provided with two (or more) bores they are spaced clear of the center of the front face 14 of the body and at the center of the front face there is located a recess 46. Preferably the bores are spaced away from the recess by equal distances and, in accordance with the invention, a cover member 48 is provided which includes a centrally disposed projection 50 slideably and frictionally insertable into the recess 46 to cover the exposed ends or heads 42 of driven fastening elements 22 located in the bores. Desirably the cover member 48 has an annular groove 52 to receive therein the nail heads 42 exposed on the outer face 14 of the hanger body after the nails have been driven into the wall 24, as should be clear in FIG. 4.

Each of the body members 12, 34 is cylindrical and each has at least one flange 54 which surrounds the front face of the hanger body with the frangible connection 28, 36 being between the flange 54 and the adjacent ends of the handles. As should be clear in FIG. 6 when a hanger body, say body 12, is nailed to a wall the single flange 54 at the front of the hanger body defines with the face of the wall 24 a channel for receiving whatever is used, e.g. wire, suspending the object being supported by the hanger in its desired location.

The invention contemplates a case hardened fastener element, such as the nails 22 shown, in combination with the hanger which nail is designed to withstand hammering into a masonry wall which may be concrete, cement, brick, stone or any similar substance.

Figure 7:
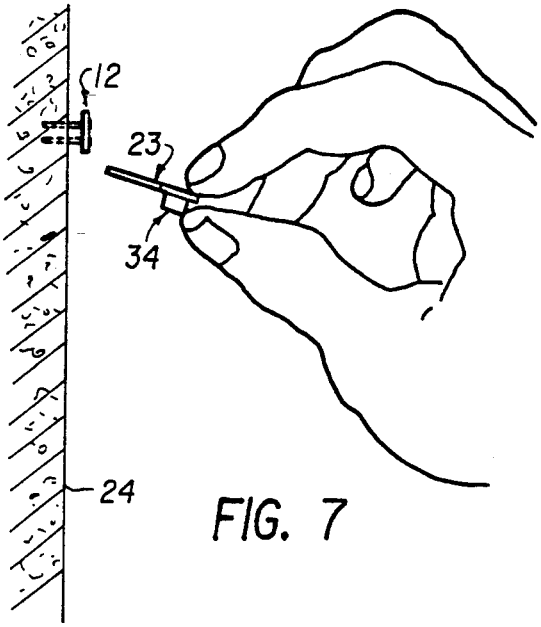
FIG. 7 shows the handle of the invention broken away from the body of the hanger.

The use of the invention should be clear in FIGS. 6 and 7. First the user pushes a fastener element into a bore with sufficient hand force to ensure that its point 40 wedges into the counter bore 44. He then grasps the handle 23 as shown in FIG. 6 with possibly an unused body member 34 attached to the opposite end of the handle as shown, and positions the body member which is being used with its inner face 16 flat against the wall 24. In so doing, the user may flex the handle 23 away from the wall as shown in FIG. 6. He thereupon hammers the nail 22 into the wall until the head 42 abuts the outer face 14 of the body member. If the user is using a multi-bore hanger he then successively inserts a nail into each bore and hammers it in. Following the hammering step, the user breaks the frangible connection between the handle and body which can be readily done by merely flexing the handle beyond its elastic limit on the upswing until it breaks clear. Thereafter, if he is using a multi-nail hanger, he applies the cap 48.

The invention will normally be packaged with several assemblies each having a multi-bore hanger body connected to one end of the handle and a single bore body at the opposite end. If the user requires several multi-bore bodies, after breaking the handle away from each nailed body, he returns the single bore body with the handle still attached to it to the package pending future use. In any event, regardless of which type of hanger is used it will invariably have a handle attached thereto until after the body has been hammered to the wall.

In my prior hangers I utilized a flange at each end of the body in order to prevent the body from sliding off the clamp of the handle. Since this is not a problem with the present invention., the inner flange can be omitted since it does little but add to expense. However, it is within the purview of the invention to have a flange at each end of the body if desired. Thus the invention is susceptible of a variety of changes and modifications without, however, departing from the scope and spirit of the appended claims.

I claim:

1. A hanger assembly for use in hanging articles on a wall comprising a first hanger body having spaced apart front and rear faces, a bore in said body extending from an open outer end at said front face into said body, said bore having a cross sectional dimension complementary to a fastening element inserted there into through the open end thereof, a handle having first and second opposed ends, one of said ends being joined by an integral frangible connection to said body, said handle having a length to permit grasping by the hand of a user to hold said body with its rear face against a wall to enable a fastening element inserted into said bore to be driven into a wall clear of the grasping hand of the user, said frangible connection being constructed to permit ready separation of said handle from said body following completion of the driving of said fastener element into a wall.

2. The hanger assembly of claim 1 including a second hanger body substantially similar to said first body and joined to the other end of said handle by a second integral frangible connection.

3. The hanger assembly of claim 1 where the frangible connection is also flexible to enable said handle to be angularly flexed away from a wall.

4. The hanger assembly of claim 2 wherein the bores in said hanger bodies terminate short of the rear face, the hanger body material being penetrable by said fastener elements.

5. The hanger assembly of claim 4 wherein the inner ends of said bores are counter bored to a lesser diameter than said bores to provide guides for frictionally wedging therein sharpened inner ends of said fastener elements when initially inserted into said bores.

6. The hanger assembly of claim 1 wherein said first hanger body has a second bore therein for a second fastener element.

7. The hanger assembly of claim 6 wherein said two bores are spaced clear of the center of said front face and including a recess in the center of said first face of said hanger body and a cover member including a centrally disposed projection slideably and frictionally insertable into said recess to cover exposed ends of driven fastening elements located in said bores.

8. The hanger assembly of claim 7 wherein said bores are spaced away from said recess by equal distances and said cover member has an annular groove surrounding said projection to receive therein heads of driven fastening elements received in said bores.

9. The hanger assembly of claim 1 wherein said hanger body is cylindrical and a flange surrounds at least the front face of said hanger body.

10. The hanger assembly of claim 9 wherein said frangible connection is between the end of said handle and said flange.

11. The hanger assembly of claim 2 wherein said first hanger body has at least two bores therein and said second hanger body has a single bore therein.

12. The hanger assembly of claim 1 including said fastening element, said element being case hardened for being hammer-driven into a wall of masonry selected from the group consisting of concrete, cement, brick and stone.

13. The hanger assembly of claim 1 including said fastener element, said element having a length that when inserted into said bore it projects beyond the open outer end of said bore for engagement by a hammer for being driven into a wall.

14. A mounting assembly for use in mounting articles on a surface comprising a body having spaced apart front and rear faces, at least one bore in said body extending from an open outer end at said front face into said by, said bore having a cross sectional dimension complementary to a fastening element inserted there into through the open end thereof, a handle having first and second opposed ends, one of said ends being joined by an integral frangible connection to said body, said handle having a length to permit grasping by the hand of a user to hold said body with its rear face against a surface to enable a fastening element inserted into said bore and projecting beyond the open outer end of said bore to be driven by a hammer into a surface clear of the grasping hand of the user, said frangible connection being constructed to permit ready separation of said handle from said body following completion of the driving of said fastener element into a surface.

15. The assembly of claim 14 including a second body substantially similar to said first body and joined to the other end of said handle by a second integral frangible connection.

16. The assembly of claim 14 wherein the frangible connection is also flexible to enable said handle to be angularly flexed away from a surface when engaged by said body.

17. The assembly of claim 14 including said fastener element, said element having a length that when inserted into said bore it projects beyond the open outer end of said bore for engagement by a hammer for being driven into a surface.

* * * * *